US007446790B2

(12) United States Patent
Takabatake

(10) Patent No.: US 7,446,790 B2
(45) Date of Patent: Nov. 4, 2008

(54) THERMAL PRINTER

(75) Inventor: Yoshinari Takabatake, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 260 days.

(21) Appl. No.: 11/585,279

(22) Filed: Oct. 24, 2006

(65) Prior Publication Data

US 2007/0091162 A1 Apr. 26, 2007

(30) Foreign Application Priority Data

Oct. 25, 2005 (JP) ..... 2005-310197

(51) Int. Cl.
*B41J 2/325* (2006.01)

(52) U.S. Cl. ..... 347/220

(58) Field of Classification Search ..... 347/197, 347/198, 220; 400/120.16, 648, 649
See application file for complete search history.

(56) References Cited

U.S. PATENT DOCUMENTS 6,232,995 B1 * 5/2001 Schartner ..... 347/220
6,789,963 B2 * 9/2004 Brahier et al. ..... 400/120.16
2001/0004264 A1 * 6/2001 Schartner ..... 347/198

FOREIGN PATENT DOCUMENTS

JP 2002-120389 4/2002

* cited by examiner

*Primary Examiner*—K. Feggins
(74) *Attorney, Agent, or Firm*—Staas & Halsey LLP

(57) ABSTRACT

A thermal printer including a thermal head; a platen cooperating with the thermal head to nip a printing sheet between the platen and the thermal head; an elastic member applying a biasing force to the thermal head in a direction to make contact with the platen; a frame supporting the thermal head in a shiftable manner and the platen in a detachable manner; and a biasing-force control mechanism controlling the biasing force of the elastic member. The biasing-force control mechanism operates to ensure, when the platen is mounted to the frame, a required contact pressure between the thermal head and the platen under the biasing force, and to prevent, when the platen is removed from the frame, the thermal head from being deformed due to the biasing force.

14 Claims, 10 Drawing Sheets

THERMAL PRINTER

BACKGROUND OF THE INVENTION

1. Field of the Invention

The present invention relates to a thermal printer.

2. Description of the Related Art

A thermal printer provided with a heat-sensitive printing section including a thermal head and a platen has a relatively small number of parts and is easily downsized and, thus, is widely adopted as a printer attached to a cash register, a portable terminal unit, an ATM (automated-teller machine) and the like. In a thermal printer of this type, it is known that the platen, acting as a back-up support to permit the thermal head to surely perform stable printing on a printing sheet (or a heat-sensitive paper), is detachably mounted on a frame supporting the thermal head (see, e.g., Japanese Unexamined Patent Publication (Kokai) No. 2002-120389 (JP-A-2002-120389)).

The thermal printer with the detachable platen has an advantage in that certain work, such as the setting of supplied or exchange new printing sheets in a printing stand-by state or the removal of a printing sheet caught or jammed in a printing section during a printing operation, can be performed easily and quickly by removing the platen from the frame. In this connection, as described in JP-A-2002-120389, the thermal printer with the detachable platen may include an openable/closable frame structure (generally referred to as a clamshell structure) that has a first frame member supporting a printing sheet in a rolled form (i.e., a roll of paper) and a second frame member pivotably joined to the first frame member and cooperating with the first frame member to define a rolled-paper housing space. In this arrangement, the thermal head is disposed on the first frame member acting as a stationary base and the platen is disposed on the second frame member acting as an openable/closable cover, so that an openable/closable printing section is thus configured.

In the thermal printer with the detachable platen, in order to ensure a contact pressure between the thermal head and the platen, which is required for continuous printing on the printing sheets, an elastic member is typically arranged between the frame and the thermal head so as to apply an urging or biasing force to the thermal head in a direction making contact with the platen mounted to the frame (i.e., disposed at a proper back-up support position). The frame supports the thermal head, adapted to receive the biasing force of the elastic member, shiftably over a predetermined stroke in opposite directions toward and away from the platen located at the proper back-up support position. As a result, a required contact pressure is generated between the thermal head and the platen, for absorbing dimensional or positional errors thereof and establishing a stable printing performance capable of following a variation in thickness of the printing sheets.

The conventional thermal printer with the detachable platen is configured such that the biasing force of the elastic member for ensuring the required contact pressure between the thermal head and the platen is continuously applied to the thermal head, even in a state where the platen is removed from the frame. In other words, during the shifting motion of the thermal head within the predetermined stroke on the frame, the thermal head always receives the biasing force of the elastic member. In this configuration, when the platen is removed from the frame, the thermal head may be deformed due to the biasing force of the elastic member continuously applied to the thermal head.

The thermal head typically has a construction wherein a heat-generating element is arranged in a linear form on a front surface of a substrate made of a rigid material, such as a ceramic, and the substrate is fixed to a metallic carrier plate having a heat-radiating function with the front surface provided with the heat-generating element being exposed. The carrier plate is provided with axles at longitudinal opposite ends defined in an extending direction of the heat-generating element, and is supported by the frame shiftably over a predetermined stroke with the axles being inserted into guide grooves formed in opposite side plates of the frame. When the platen is removed from the frame, the thermal head having the above-described opposite-ends supported structure is adapted to be continuously subjected to the biasing force of the elastic member, in a state where the axles at the opposite ends of the carrier plate are engaged with the peripheries of the corresponding guide grooves at the limit of a shifting stroke. As a result, a central region of the carrier plate of the thermal head may be deflected (or bent) so as to convexly protrude at the side of the heat-generating element.

The above-described problem of the bending of the thermal head becomes more apparent, as the thermal head is enlarged in a paper-width direction so as to follow the requirement of increasing in width of the printable area in the printing sheet. This is because, even if the paper width is increased, a contact pressure per unit area, required for a stable printing, does not change and, as a result, the biasing force of the elastic member must be increased. If the carrier plate of the thermal head is bent, the substrate made of the rigid material may be peeled off at the opposite ends thereof, defined in the extending direction of the heat-generating element, from the carrier plate so as to rise above the latter. Further, as the period of the removal of the platen increases, the bend of the carrier plate of the thermal head may possibly result in a plastic deformation. The possible plastic deformation of the carrier plate affects a printing quality and, as a result, the thermal head may have to be exchanged with a new one.

The bending of the thermal head also influences the work for mounting the platen to the frame. More specifically, if the platen is handled to be mounted to the frame in a state where the thermal head is bent, the surface (typically made of a rubber) of the platen may possibly be damaged or deformed due to a forcible interference with the thermal head, even when the bend is due to an elastic deformation. The damage or deformation of the surface of the platen also affects a printing quality and, therefore, the platen may have to be exchanged with a new one. In a case where the rigidity of the thermal head is increased by, e.g., increasing the thickness of the carrier plate, to solve the above-described problem relating to the bend of the thermal head, it is, on the other hand, required to consider the outer dimensions, internal space dimensions, assembling workability, etc., of the thermal printer and, therefore, it is often difficult to increase the rigidity of the carrier plate under certain structural restrictions.

SUMMARY OF THE INVENTION

It is an object of the present invention to provide a thermal printer, with a detachable platen, which can prevent, by a simple structural solution, a thermal head from being deformed due to the biasing force of an elastic member for ensuring a required contact pressure to the platen, and which can effectively inhibit the deterioration of a printing quality and reduce the burden of maintenance, even under certain structural restrictions in connection with dimensions or assembling workability.

To accomplish the above object, the present invention provides a thermal printer comprising a thermal head; a platen cooperating with the thermal head to nip a printing sheet between the platen and the thermal head; an elastic member applying a biasing force to the thermal head in a direction making contact with the platen; a frame supporting the thermal head in a shiftable manner and the platen in a detachable manner; and a biasing-force control mechanism controlling the biasing force of the elastic member, the biasing-force control mechanism operating to ensure, when the platen is mounted to the frame, a required contact pressure between the thermal head and the platen under the biasing force and to prevent, when the platen is removed from the frame, the thermal head from being deformed due to the biasing force.

In the above thermal printer, the biasing-force control mechanism may comprise a deflection-defining element defining an amount of deflection of the elastic member in a predetermined deflection range such as to generate the contact pressure due to the biasing force when the platen is mounted to the frame and to reduce the biasing force when the platen is removed from the frame.

In this arrangement, the elastic member may comprise a plate spring; and the deflection-defining element may comprise an anchoring element formed in the plate spring and adapted to be engaged with the plate spring itself to limit the amount of deflection within the deflection range.

Alternatively, the elastic member may comprise a plate spring; and the deflection-defining element may comprise an anchoring element attached to the plate spring and adapted to be engaged with the plate spring to limit the amount of deflection within the deflection range.

Alternatively, the elastic member may comprise a plate spring; and the deflection-defining element may comprise an anchoring element provided in the frame and adapted to be engaged with the plate spring to limit the amount of deflection within the deflection range.

The anchoring element may anchor, when the platen is removed from the frame, the elastic member at an initial deflection position where the contact pressure can be generated by an additional deflection of the elastic member within the deflection range.

Alternatively, the elastic member may comprise a plate spring; and the deflection-defining element may comprise a spring support element provided in the thermal head and adapted to cause a deflection in the plate spring within the deflection range.

Alternatively, the elastic member may comprise a non-linear spring generating the biasing force assuming non-linear relationship with the amount of deflection; and the deflection-defining element may comprise a spring support element provided in the frame and adapted to cause a deflection in the non-linear spring within the deflection range.

In the above thermal printer, the biasing-force control mechanism may comprise a guiding element guiding the thermal head on the frame in a predetermined shifting range such as to generate the contact pressure due to the biasing force when the platen is mounted to the frame and to reduce the biasing force when the platen is removed from the frame.

In this arrangement, the thermal head may comprise a substrate, a heat-generating element disposed on a surface of the substrate, and a carrier plate carrying the substrate with the surface being exposed, the carrier plate being supported on the frame substantially at opposite ends of the carrier plate and guided by the guiding element.

In the above thermal printer, the biasing-force control mechanism may operate to arrange the elastic member and the thermal head in a relative positional relationship in which, when the platen is removed from the frame, the biasing force is substantially not applied to the thermal head.

In the above thermal printer, the biasing-force control mechanism may operate to arrange the elastic member and the thermal head in a mutual contact relationship in which, when the platen is removed from the frame, unsteadiness of the thermal head on the frame is prevented.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
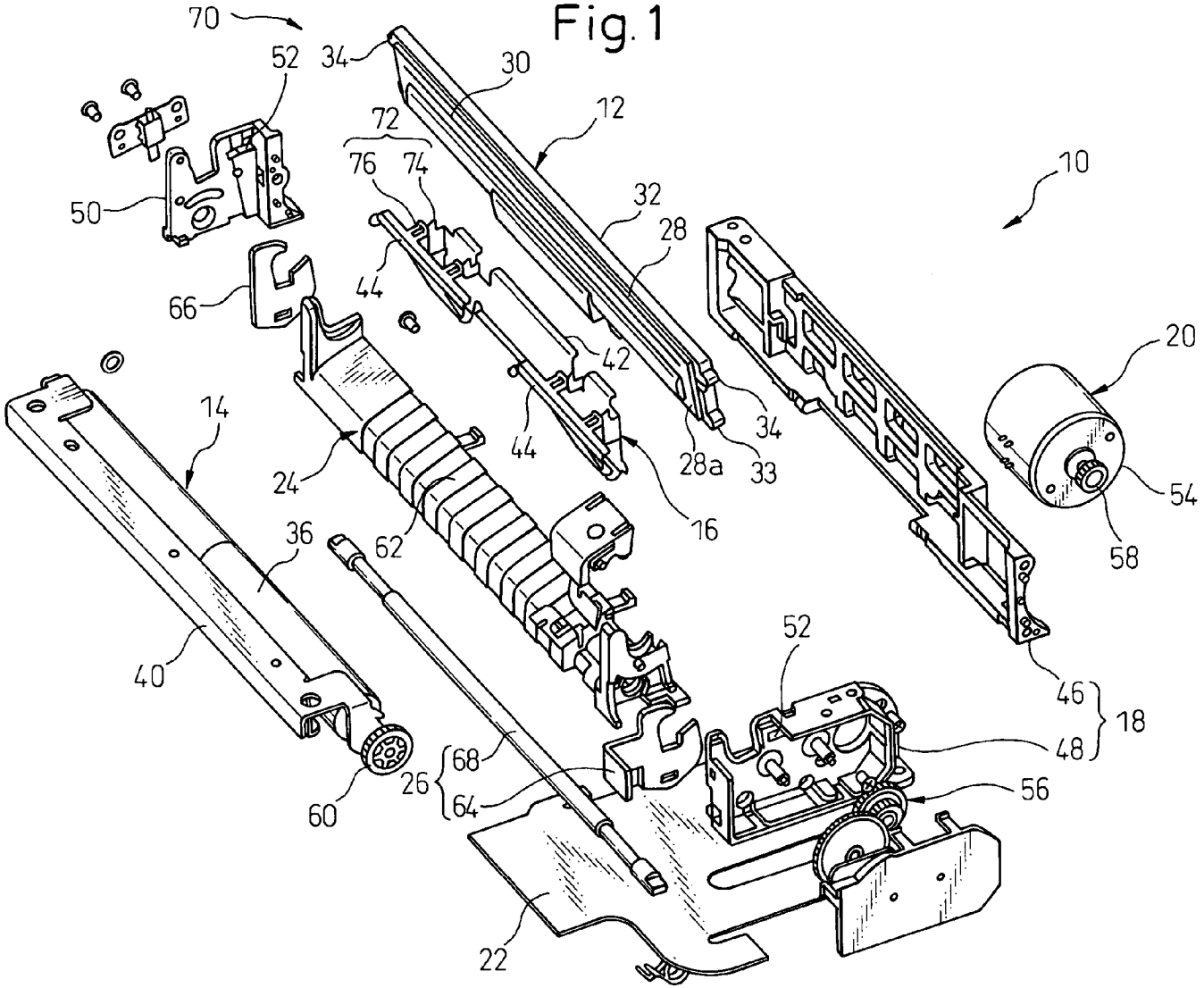
FIG. 1 is an exploded perspective view showing a thermal printer according to an embodiment of the present invention.

The embodiments of the present invention are described below, in detail, with reference to the accompanying drawings. In the drawings, the same or similar components are denoted by common reference numerals.

Figure 2:
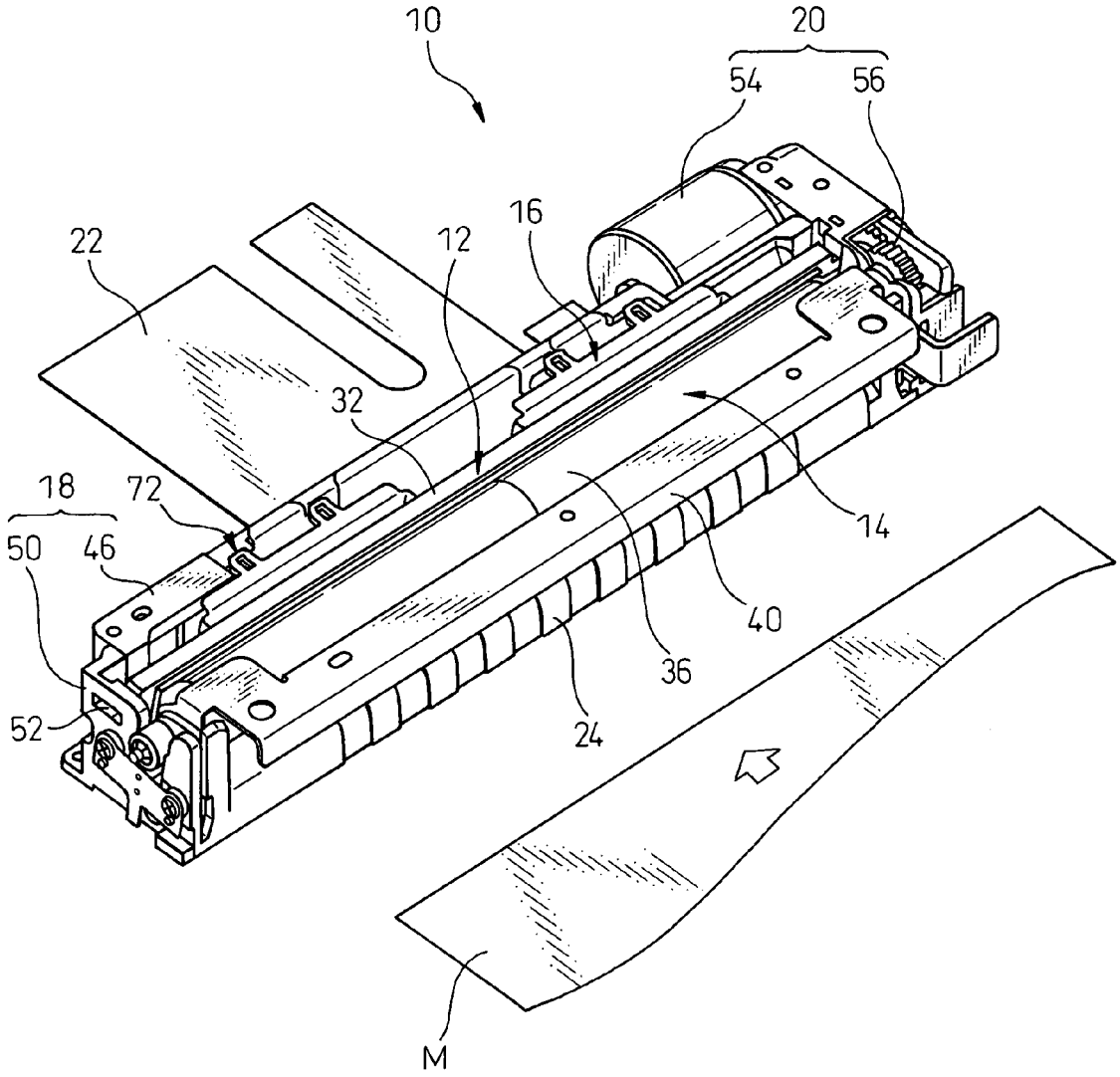
FIG. 2 is a perspective view showing the thermal printer of FIG. 1 in an assembled state.
Figure 3A:
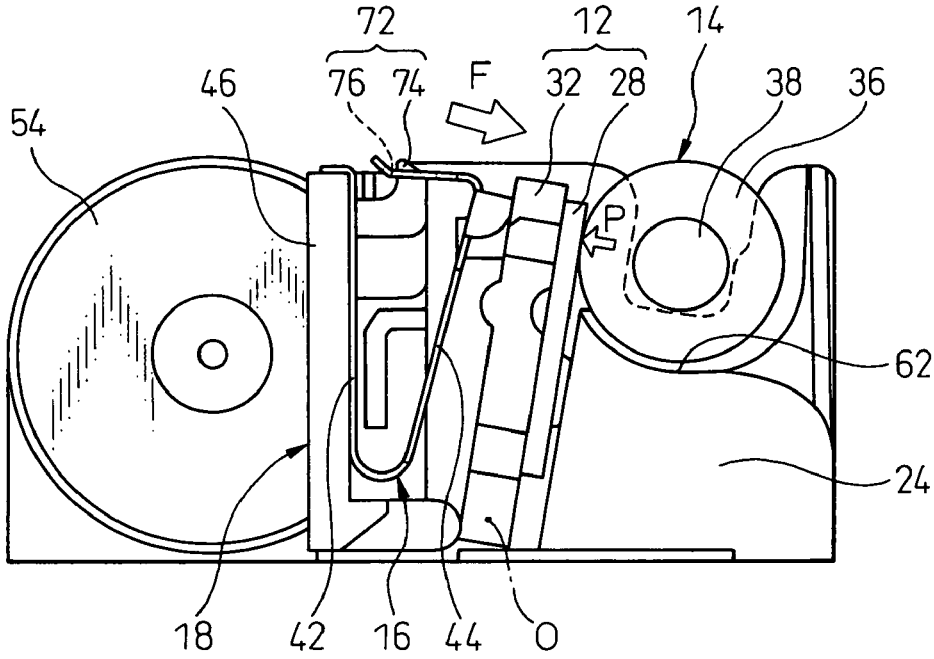
FIG. 3A is a side view illustrating a function of a biasing-force control mechanism in the thermal printer of FIG. 1, with one of side plate members being omitted and a platen being attached.
Figure 3B:
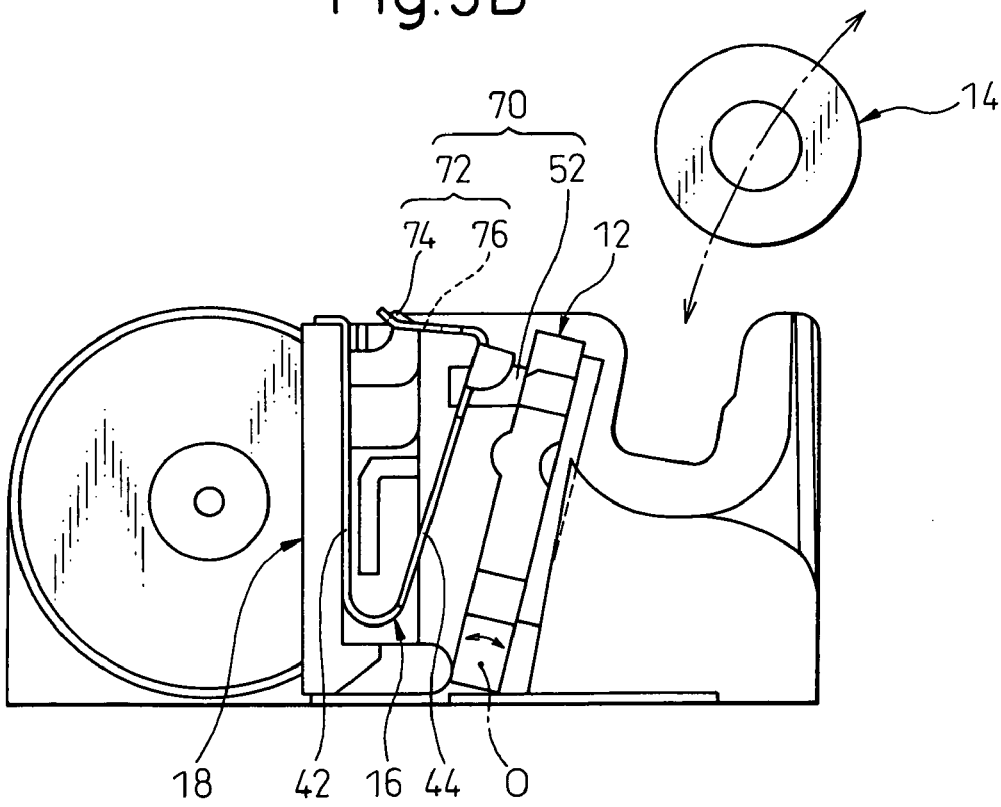
FIG. 3B is a side view corresponding to FIG. 3A, with the platen being removed.

Referring to the drawings, FIG. 1 is an exploded perspective view of a thermal printer 10 according to a first embodiment of the present invention, FIG. 2 is a perspective view of the thermal printer 10 in an assembled state, and FIGS. 3A and 3B are side views respectively illustrating a biasing-force controlling function in the thermal printer 10 with one of the side plate members being omitted. While the thermal printer 10 according to the illustrated embodiment can be used as a printer attached to a cash register, a portable terminal unit, an ATM (automated teller machine) and the like, the thermal printer according to the present invention is not limited to the above applications.

The thermal printer 10 includes a thermal head 12, a platen 14 cooperating with the thermal head 12 to nip or hold a printing sheet M between the platen 14 and the thermal head 12 under an elastic urging or biasing force, an elastic member 16 applying the urging or biasing force to the thermal head 12 in a direction making the thermal head 12 contact with the platen 14, and a frame 18 supporting the thermal head 12 in a shiftable manner and the platen 14 in a detachable manner. The thermal printer 10 also includes a drive mechanism 20 driving the platen 14 for rotation, a flexible circuit board 22 electrically connected with the thermal head 12 and the drive mechanism 20, a sheet guide 24 disposed adjacent to the platen 14, and a retaining mechanism 26 releasably retaining the platen 14 at a proper back-up support position on the frame 18.

The thermal printer 10 may be configured as a printing apparatus having an openable/closable frame structure (generally referred to as a clamshell structure) including a first frame member (not shown) supporting a printing sheet in a rolled form (i.e., a rolled paper), and a second frame member (not shown) pivotably joined to the first frame member and cooperating with the first frame member to define a rolled-paper housing space. In this configuration, the frame 18, supporting the thermal head 12, the elastic member 16, the drive mechanism 20, the sheet guide 24 and the retaining mechanism 26, is disposed on the first frame member acting as a stationary base, while the platen 14 is disposed on the second frame member acting as an openable/closable cover.

The thermal head 12 includes a substrate 28 as a rectangular flat plate preferably made of a rigid material, such as a ceramic, a heat-generating element 30 disposed at a desired position on a substantially flat surface (or a printing surface) 28*a* of the substrate 28, and a metallic carrier plate 32 securely carrying the substrate 28 with the printing surface 28*a* and the heat-generating element 30 being exposed. The thermal head 12 has a so-called line-dot configuration, in which a large number of dot-like heat-generating pieces are arranged in a linear array on the surface of the substrate 28 to form the heat-generating element 30, and which performs a printing operation by electrically scanning the heat-generating pieces. The carrier plate 32 is provided with lower axles 33 and upper slide shafts 34, at longitudinal opposite ends defined in an extending direction of the heat-generating element 30. The carrier plate 32 is supported by the frame 18 shiftably or pivotably over a predetermined stroke, with the slide shafts 34 being inserted respectively into guiding elements formed in opposite side plates of the frame 18, as described later.

The platen 14 includes a body 36 shaped as a cylindrical roller and preferably made of an elastic material, such as rubber, and a shaft 38 (see FIG. 3A) fixedly provided along a central axis of the body 36 and projecting from the longitudinal opposite ends of the body 36 so as to be rotatably supported by a support member (or a second frame member) 40. The platen 14 is rotatably mounted at the proper back-up support position (FIG. 3A) on the frame 18 through the shaft 38 as described later. In this state, an outer circumferential surface of the body 36 is located oppositely to and substantially parallel with the printing surface 28*a* of the thermal head 12.

In a state where the platen 14 is arranged at the back-up support position on the frame 18, the platen 14 is rotationally driven by the drive mechanism 20, so as to continuously feed the printing sheet M, which is, e.g., unrolled from the rolled paper, while nipping or holding the printing sheet M between the thermal head 12 and the platen 14 under pressure. In this state, the thermal head 12 performs a desired printing operation on the printing sheet M, by electrically actuating the heat-generating element 30 provided on the printing surface 28*a* of the thermal head 12. Thus, the platen 14 acts as a back-up support roller to permit the thermal head 12 to surely perform a stable printing on the printing sheet M and, at the same time, acts as a drive roller for continuously feeding the printing sheet M by a friction force.

The elastic member 16 is configured as a plate spring made of a sheet metal material, and includes a support portion 42, and a pair of acting portions 44, each of which extends integrally from the support portion 42 via a bending region having a U-shaped cross section. The elastic member 16 is configured such that the acting portions 44 are spaced from the support portion 42 at a predetermined distance in an unloaded condition and, on the other hand, each acting portion 44 generates a spring force, assuming a linear relationship with an amount of deflection, by receiving an external force in a direction toward the support portion 42. The spring force of the elastic member 16 functions as an urging or biasing force F (FIG. 3A) for urging or biasing the thermal head 12 in a direction bringing the thermal head 12 into contact with the platen 14, so as to surely obtain the contact pressure, between the thermal head 12 and the platen 14, required for a continuous printing performed on the printing sheet M.

The frame 18 is made of a rigid material, such as metal or resin, as a whole and includes a main plate member 46 having a substantially rectangular shape as seen in a plan view, and a pair of side plate members 48, 50, each of which being fixedly joined to the longitudinal opposite ends of the main plate member 46 and extending in a direction generally orthogonal to the main plate member 46. The main plate member 46 of the frame 18 securely supports the support portion 42 of the elastic member 16, and is abutted at the bottom end of the main plate member 46 against the bottom end of the carrier plate 32 of the thermal head 12, so as to define a center "O" of the swinging or pivoting motion of the thermal head 12 (see FIGS. 3A and 3B). The side plate members 48, 50 of the frame 18 are disposed oppositely to and parallel with each other with a predetermined distance defined therebetween, and are respectively provided at mutually corresponding positions with groove-shaped guiding elements 52 formed to extend arcuately over a predetermined length. The guiding elements 52 slidably receive the respective slide shafts 34 provided at the opposite ends of the carrier plate 32 of the thermal head 12.

Consequently, the frame 18 detachably supports the platen 14 and, also, supports the thermal head 12 shiftably in opposite directions toward and away from the platen 14 mounted at the back-up support position. The thermal head 12 is stably guided along the guiding elements 52 in a state where the carrier plate 32 of the thermal head 12 is supported substantially at its opposite ends on the frame 18. According to this configuration, in a case where, e.g., a printing operation is performed continuously on several types of printing sheets having different thicknesses, the thermal head 12 can be moved in directions toward or away from the platen 14 in an automatic or passive manner while receiving the biasing force generated by the elastic member 16, so as to accurately hold or nip the several types of printing sheets between the thermal head 12 and the platen 14 under an appropriate pressure.

The drive mechanism 20 includes a rotary drive source 54 formed as, e.g., a pulse motor, and a gear unit 56 provided as a power transmission mechanism for transmitting an output (or a torque) of the rotary drive source 54 to the platen 14. The rotary drive source 54 is disposed at a back side of the main plate member 46 of the frame 18, and the gear unit 56 is disposed within a box-like part formed by one side plate member 48 of the frame 18. A driving gear 58, attached to an output shaft of the rotary drive source 54, is operatively coupled with a driving side of the gear unit 56. When the platen 14 is arranged at the proper back-up support position on the frame 18, a driven gear 60, attached to one end of the shaft 38 of the platen 14, is operatively coupled with a driven side of the gear unit 56. In this state, the output power of the rotary drive source 54 is transmitted to the platen 14. On the other hand, when the platen 14 is detached from the frame 18, the driven gear 60 of the platen 14 is disengaged from the gear unit 56, so that the platen 14 is separated or isolated from the rotary drive source 54.

The sheet guide 24 is formed as, e.g., a resin molded article, and includes a concavely-curved guide surface 62 corresponding to a cylindrical outer circumferential surface of the body 36 of the platen 14 located at the back-up support position. The sheet guide 24 is disposed in a stationary manner between the opposite side plate members 48, 50 of the frame 18 with the guide surface 62 facing the body 36 of the platen 14. The guide surface 62 of the sheet guide 24 preferably extends across generally the axial entire length of the platen body 36, and thereby a sheet passage having a generally uniform gap is defined between the guide surface 62, the outer circumferential surface of the platen body 36 and the side plate members 48, 50 of the frame 18.

The retaining mechanism 26 includes a first hook element 64 and a second hook element 66, each of which is disposed adjacent to each of the longitudinal ends of the sheet guide 24, and a connecting shaft 68 for connecting the hook elements 64, 66 with each other in a mutually interlocking manner. When the platen 14 is arranged at the back-up support position on the frame 18, the first and second hook elements 64, 66 of the retaining mechanism 26 are engaged with the longitudinal opposite-end lengths of the shaft 38 (FIG. 3A) of the platen 14 in a hooking manner, so as to retain the platen 14 at the back-up support position. In order to detach the platen 14 from the frame 18, the first hook element 64 having an operating lever is manually operated to rotate the first and second hook elements 64, 66 in the mutually interlocking manner about the connecting shaft 68, so as to disengage the hook elements 64, 66 from the shaft 38 of the platen 14.

In the thermal printer 10 configured as described above, it is possible to easily and quickly perform certain work, such as the setting of supplied or exchanged new printing sheets in a printing stand-by state or the removal of a printing sheet caught or jammed in a printing section during a printing operation, by detaching or removing the platen 14 from the frame 18. Moreover, the thermal printer 10 is characterized by a provision of a biasing-force control mechanism 70 for controlling the urging or biasing force of the elastic member 16, in order to prevent the thermal head 12 from being deformed due to the biasing force of the elastic member 16 during a period when the platen 14 is removed from the frame 18. The biasing-force control mechanism 70 is configured to operate for ensuring, when the platen 14 is mounted to the frame 18 (FIG. 3A), a required contact pressure P between the thermal head 12 and the platen 14 under the biasing force F, and for preventing, when the platen 14 is removed from the frame 18, the thermal head 12 (in particular, the carrier plate 32) from being deformed due to the biasing force F.

Figure 4:
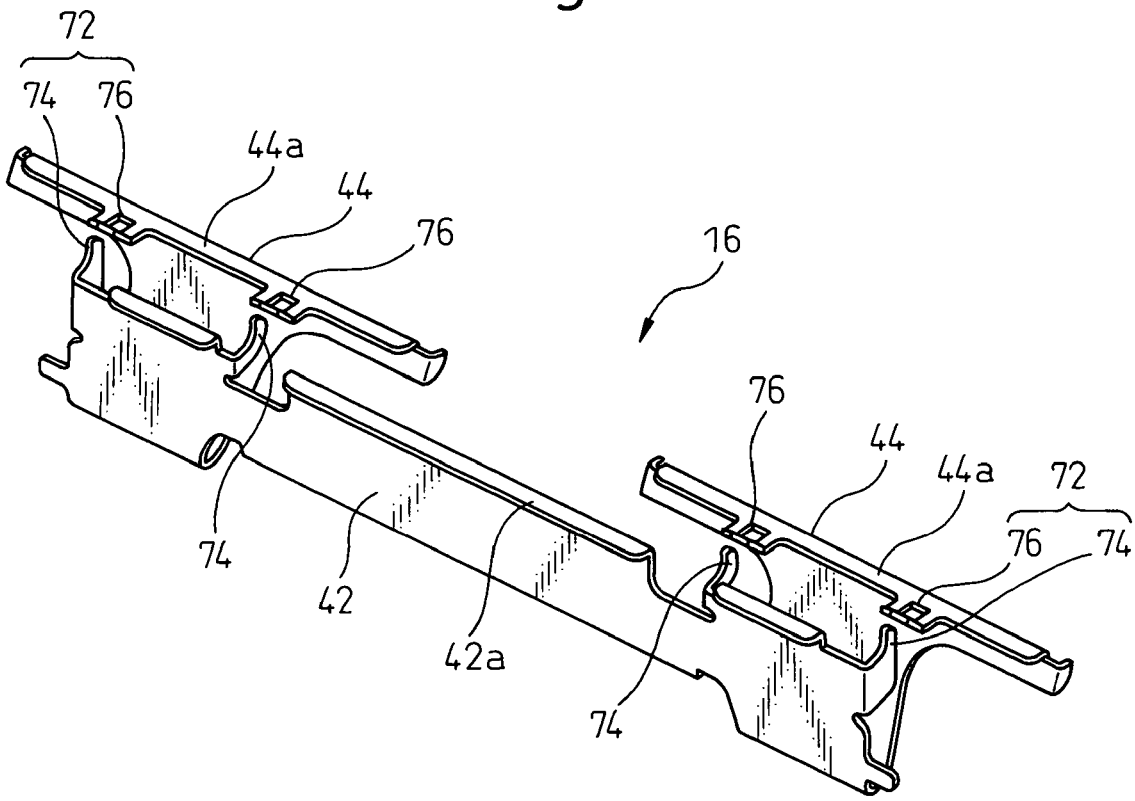
FIG. 4 is an enlarged perspective view showing an elastic member in the thermal printer of FIG. 1.

As shown in FIGS. 3A to 5C, the biasing-force control mechanism 70 of the thermal printer 10 includes a deflection-defining element 72 defining an amount of deflection α (FIG. 5A) of the elastic member 16 in a predetermined deflection range R (FIG. 5B) such as to generate the contact pressure P due to the biasing force F during a period when the platen 14 is mounted to the frame 18 (FIG. 3A), and as to reduce the biasing force F during a period when the platen 14 is removed from the frame 18 (FIG. 3B). In the illustrated embodiment, the deflection-defining element 72 includes an anchoring element 74 formed in the elastic member (or the plate spring) 16 and adapted to be engaged with the elastic member (or the plate spring) 16 itself to limit the amount of deflection α within the deflection range R (FIG. 4).

As shown in FIG. 4, the elastic member 16 is provided with two pairs of the anchoring elements 74, each of which is formed, as a claw-like extension, integrally with the top region 42*a* (or the end region remote from the U-shaped joint regions leading to the acting portions 44) of the support portion 42, and which are arranged in a symmetrically distributed manner. The elastic member 16 is further provided with two pairs of engagement recesses 76, each of which is formed as a through-hole at the free end regions 44*a* (or the end regions remote from the U-shaped joint regions leading to the support portion 42) of the pair of acting portions 44, and which are arranged in a symmetrically distributed manner corresponding to the arrangement of the anchoring elements 74. Each anchoring element 74 has a dimension, and a shape, adapted to be received in the corresponding engagement recess 76 with a predetermined clearance defined therebetween.

Figure 5A:
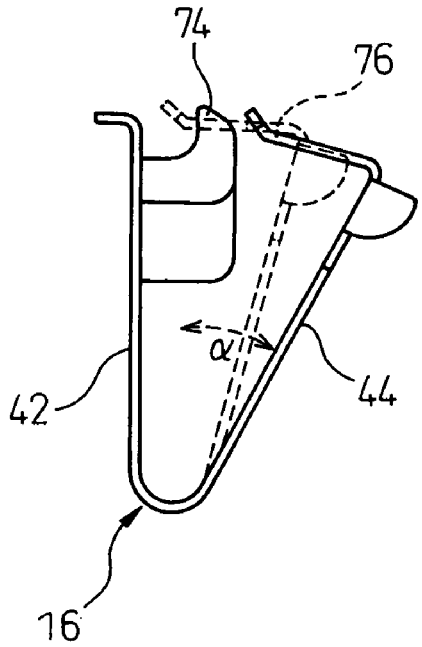
FIG. 5A is a side view showing the elastic member of FIG. 4, which illustrates a biasing-force control mechanism in relation to the elastic member.

As shown in FIG. 4, the elastic member 16 exhibits, in an unloaded condition before being incorporated into the thermal printer 10, a form such that the anchoring elements 74 and the engagement recesses 76, constituting the deflection-defining elements 72, are not engaged with each other. On the other hand, in the assembling process of the thermal printer 10, when the respective acting portions 44 of the elastic member 16 are elastically deformed (as shown by broken lines) from the unloaded condition (as shown by solid lines) toward the support portion 42 so as to obtain the amount of deflection α, as shown in FIG. 5A, the free end regions 44*a* of the acting portions 44 are abutted against the distal ends of the anchoring elements 74 of the support portion 42 at a predetermined position. When the acting portions 44 are further deflected, the free end regions 44*a* are elastically deformed to climb over the distal ends of the anchoring elements 74, so that the respective anchoring elements 74 are snap-fitted into the corresponding engagement recesses 76.

In the above engaged state of the elastic member 16, the amount of deflection α of the respective acting portions 44 relative to the support portion 42 is limited to the deflection range R determined by a dimensional relationship between the anchoring elements 74 and the engagement recesses 76. At this time, when the external force to the acting portions 44 is released, the respective anchoring elements 74 are engaged with edges Q (FIG. 5B) of the corresponding engagement recesses 76 and, therefore, the acting portions 44 are anchored at a predetermined initial deflection position. The initial deflection position is defined as a position where the acting portions 44 can generate the required contact pressure P (FIG. 3A) due to an additional deflection (in a direction toward the support portion 42) within the deflection range R.

The thermal printer 10 is assembled by incorporating the elastic member 16, provided in a condition where the amount of deflection α is limited within the deflection range R by the deflection-defining elements 72 as described above, between the carrier plate 32 of the thermal head 12 and the main plate member 46 of the frame 18 in the above-described orientation. In the thermal printer 10 thus assembled, during a period when the platen 14 is mounted to the frame 18 (FIG. 3A), the respective acting portions 44 of the elastic member 16 are subjected to the additional deflection within the deflection range R, due to the pressing force applied from the platen 14 to the acting portions 44 through the thermal head 12 in the direction toward the support portion 42, so that the biasing force F resulted from the additional deflection generates the required contact pressure P between the thermal head 12 and the platen 14. On the other hand, during a period when the platen 14 is removed from the frame 18 (FIG. 3B), the pressing force applied from the platen 14 to the respective acting portions 44 of the elastic member 16 disappears and, therefore, the acting portions 44 are elastically restored within the deflection range R and anchored at the initial deflection position where the respective anchoring elements 74 are engaged with the edges Q (FIG. 5B) of the corresponding engagement recesses 76. The thermal printer 10 is configured such that, in the above-described anchored state, the thermal head 12 is located at a position where the biasing force F from the elastic member 16 is reduced, to such an extent as to cause no deformation of the thermal head 12, so that it is possible to solve various problems resulted from the deformation of the thermal head 12.

Figure 6:
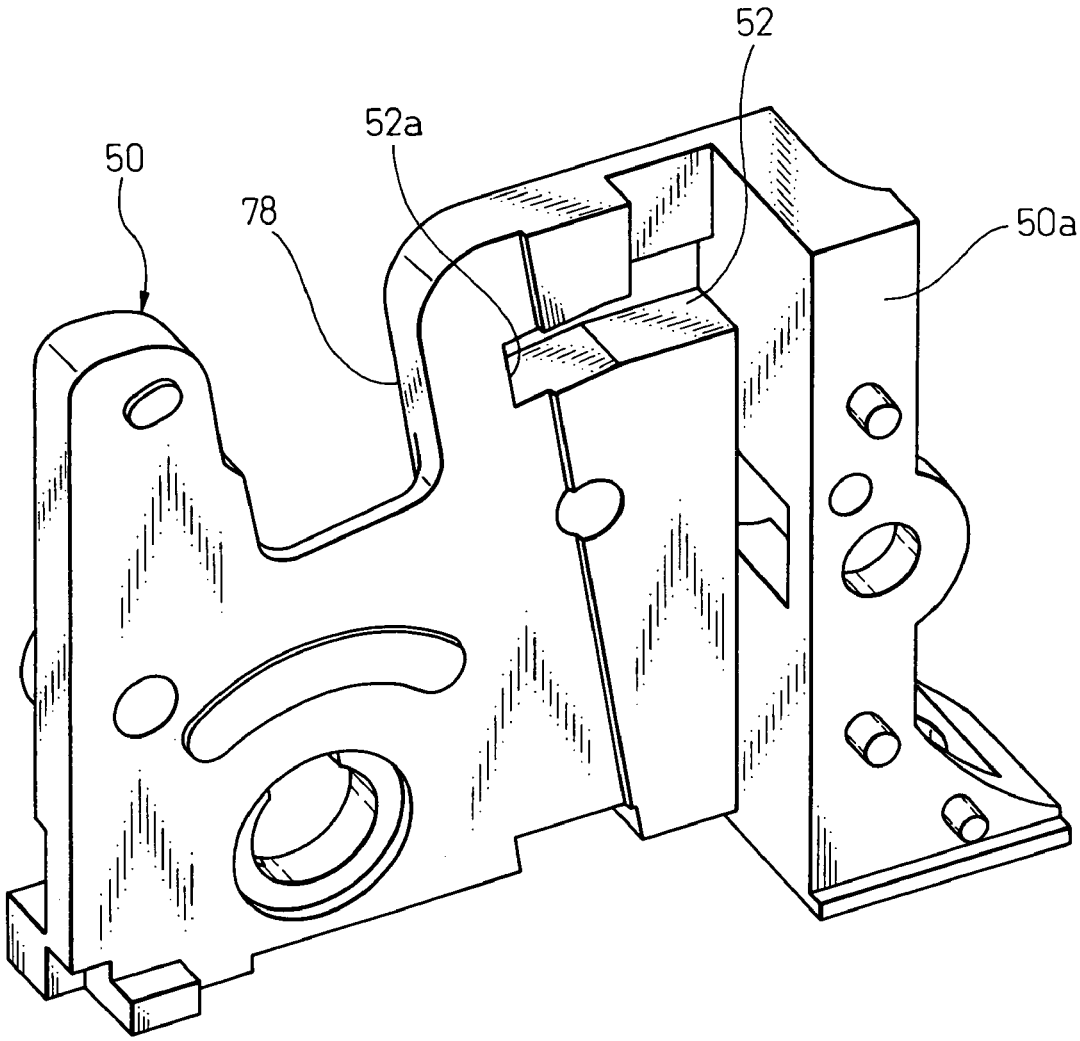
FIG. 6 is an enlarged perspective view showing one of the side plate members in the thermal printer of FIG. 1 and showing a guiding element formed therein.

The position of the thermal head 12 during the period when the platen 14 is removed from the frame 18 is determined by the cooperation between the slide shafts 34 formed at the opposite ends of the carrier plate 32 of the thermal head 12 and the guiding elements 52 formed on the opposite side plate members 48, 50 of the frame 18. As shown with respect to one side plate member 50 in FIG. 6, the guiding element 52 is formed through the side plate member 50 as a slot extending arcuately at a location near the top edge of the side plate member 50. The side plate member 50 is provided with a recess 78 for receiving the shaft 38 (FIG. 3A) of the platen 14, and the guiding element 52 is disposed between an attachment portion 50*a* of the side plate member 50 relative to the main plate member 46 and the recess 78. The guiding element 52 is formed while appropriately adjusting the position of the end 52*a* of the guiding element 52, at a side adjacent to the recess 78 and, thereby, the position of the thermal head 12 during the period when the platen 14 is removed from the frame 18 is determined. It should be noted that the guiding element 52 provided in the other side plate member 48 is configured similarly.

As described above, the guiding element 52 provided in the frame 18 cooperates with the slide shaft 34 provided in the thermal head 12 to guide the thermal head 12 on the frame 18 over a predetermined shifting range, such as to generate the contact pressure P due to the biasing force F of the elastic member 16 when the platen 14 is mounted to the frame 18 (FIG. 3A), and as to reduce the biasing force F when the platen 14 is removed from the frame 18 (FIG. 3B). Therefore, the guiding element 52 and the slide shaft 34 are components of the biasing-force control mechanism 70 (FIG. 1).

The thermal printer 10 is configured such that the position of the edges 52*a* of the respective guiding elements 52 can be appropriately adjusted and, thereby, the elastic member 16 (or the acting portions 44) and the thermal head 12 can be arranged, during the period when the platen 14 is removed from the frame 18, in a relative positional relationship in which the biasing force F of the elastic member 16 is substantially not applied to, or is slightly applied to, the thermal head 12. If the biasing force of the elastic member 16 to the thermal head 12 is substantially zero during the period when the platen 14 is removed from the frame 18, the problem of bending of the thermal head 12 can be surely solved. At this time, due to the correlation between the deflection range R of the elastic member 16 defined by the deflection-defining elements 72 and the shifting range of the thermal head 12 defined by the guiding elements 52, it is also possible to locate the thermal head 12 at a position as to be completely separated from the elastic member 16, as shown in FIG. 3B. Further, while the platen 14 is removed from the frame 18, if a mutual contact relationship is maintained between the thermal head 12 and the elastic member 16, in which a small biasing force is applied from the elastic member 16 to the thermal head 12 to such an extent as to cause no deformation of the thermal head 12 (in particular, the carrier plate 32), it is possible to solve the problem of bending of the thermal head 12 while preventing the unsteadiness or fluctuation of the thermal head 12 during the period when the platen is removed.

According to the thermal printer 10 configured as described above, a simple structural solution wherein the amount of deflection of the elastic member 16 is limited without increasing the rigidity of the carrier plate 32 of the thermal head 12 is provided and, thereby, it is possible to prevent the thermal head 12 from being deformed due to the biasing force of the elastic member 16 while ensuring the required contact pressure between the thermal head 12 and the platen 14. Further, the anchoring element 74 is provided to anchor the elastic member 16 at the predetermined initial deflection position and, thereby, at an instant when the platen 14 is attached to the frame 18, it is possible to surely prevent the surface of the platen 14 from being damaged or deformed due to the interference with the thermal head 12. As a result, it is possible to eliminate the influences on a printing quality, due to the plastic deformation of the carrier plate 32 or the damage of the surface of the platen 14, and thus to significantly reduce the frequency of the exchange of the thermal head 12 and/or the platen 14 for new one.

Figure 7:
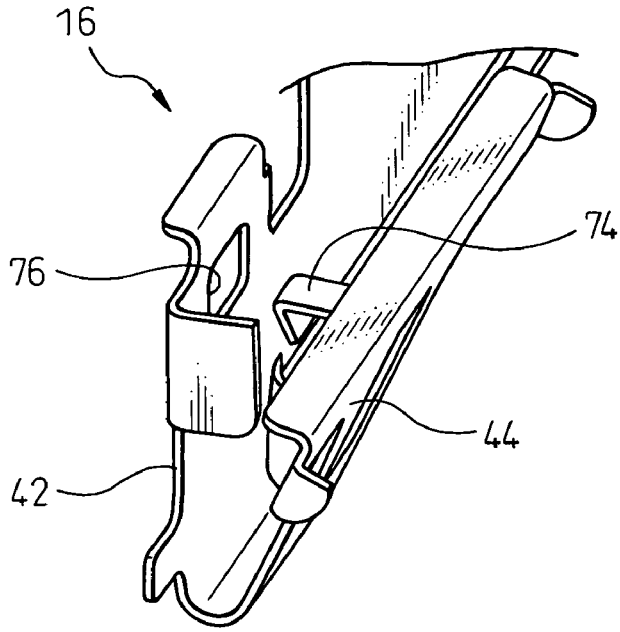
FIG. 7 is an enlarged perspective view showing a modification of the deflection-defining element.

The above-described configuration of the biasing-force control mechanism 70 in the thermal printer 10 may be variously modified, depending on certain restrictions on the dimensions and/or assembling workability of the thermal printer 10. For example, as shown in FIG. 5C, the respective acting portions 44 may be provided with the anchoring elements 74 and the support portion 42 may be provided with the engagement recesses (or through-holes) 76 engagable with the corresponding anchoring elements 74, as the deflection-defining elements 72 formed in the elastic member 16. In this configuration, the amount of deflection $\alpha$ (FIG. 5A) of the elastic member 16 is also limited within the deflection range R determined by the dimensional relationship between the anchoring elements 74 and the engagement recesses 76. When the external force on the acting portions 44 is released, the respective anchoring elements 74 are engaged with edges Q of the corresponding engagement recesses 76 and, therefore, the acting portions 44 are anchored at the predetermined initial deflection position. The deflection-defining elements 72 formed in the elastic member 16 may be configured by variously selecting the positions, dimensions and shapes of the anchoring elements 74 and the engagement recesses 76, as shown, e.g., in FIG. 7.

Figure 8:
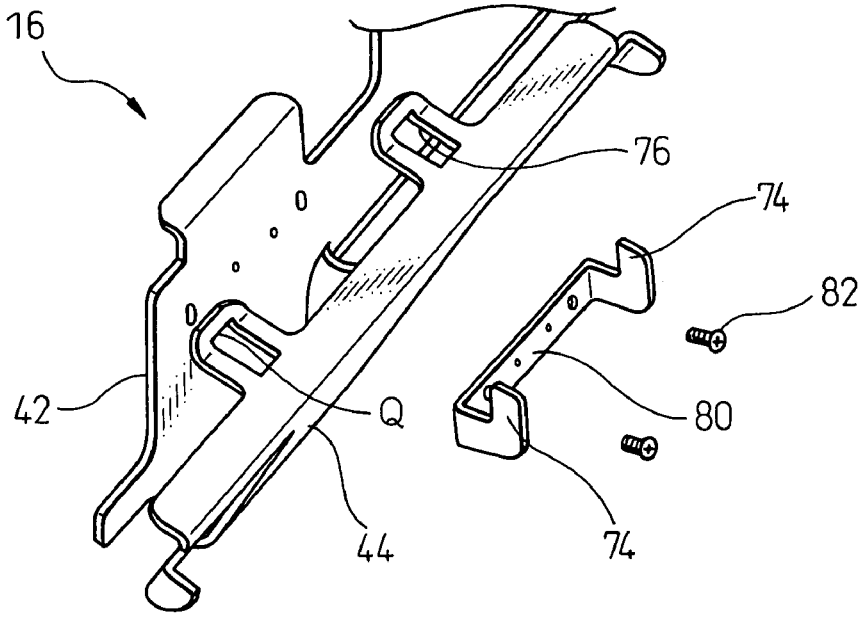
FIG. 8 is an enlarged perspective view showing another modification of the deflection-defining element.

As shown in FIG. 8, the anchoring elements 74 constituting the deflection-defining elements 72 may be formed in a separate member 80 fixedly attached to the elastic element 16, instead of being formed directly in the elastic member 16 as the plate spring. In the illustrated example, the member 80, including a pair of anchoring elements 74 formed as claw-like extensions, is fixed to the support portion 42 of the elastic member 16 by using bolts 82. In this state, the anchoring elements 74 formed on the member 80 are engaged with the engagement recesses 76 formed in the acting portions 44 of the elastic member 16 and, thereby, limit the amount of deflection α (FIG. 5A) of the acting portions 44 within the deflection range R (FIG. 5B) as described above. Also, the respective anchoring elements 74 are engaged with the edges Q of the corresponding engagement recesses 76 and, thereby, the respective acting portions 44 are anchored at the predetermined initial deflection position.

Figure 9:
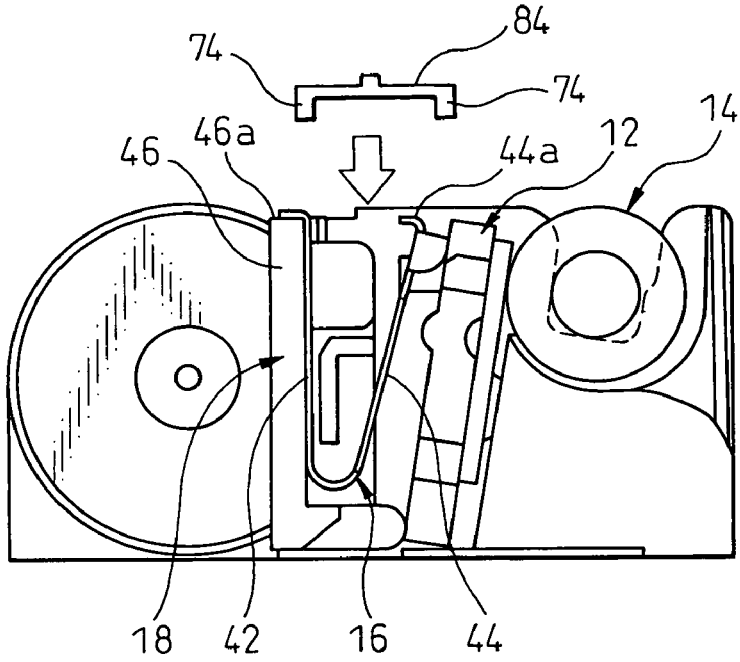
FIG. 9 is a side view corresponding to FIG. 3A and showing a further modification of the deflection-defining element.

Further, as shown in FIG. 9, the anchoring elements 74 constituting the deflection-defining elements 72 may be formed in a separate member 84 detachably attached to the elastic member 16. In the illustrated example, the member 84, including a pair of anchoring elements 74 formed as claw-like extensions, is attached to the acting portions 44 of the elastic member 16 and the main plate member 46 of the frame 18, so as to cover the free end regions 44*a* of the acting portions 44 and the top end region 46*a* of the main plate member 46. In this state, the anchoring elements 74 of the member 84 are engaged with the acting portions 44 and the main plate member 46, so as to anchor the acting portions 44 at the initial deflection position and thus to limit the amount of deflection α (FIG. 5A) of the acting portions 44 within the deflection range R (FIG. 5B), as described above. It should be noted that, in this configuration, it is advantageous to attach the member 84 to the acting portions 44 and the main plate member 46 only in the period when the platen 14 is removed from the frame 18, from the viewpoint of eliminating the influences of the member 84 to the printing operation.

Figure 10:
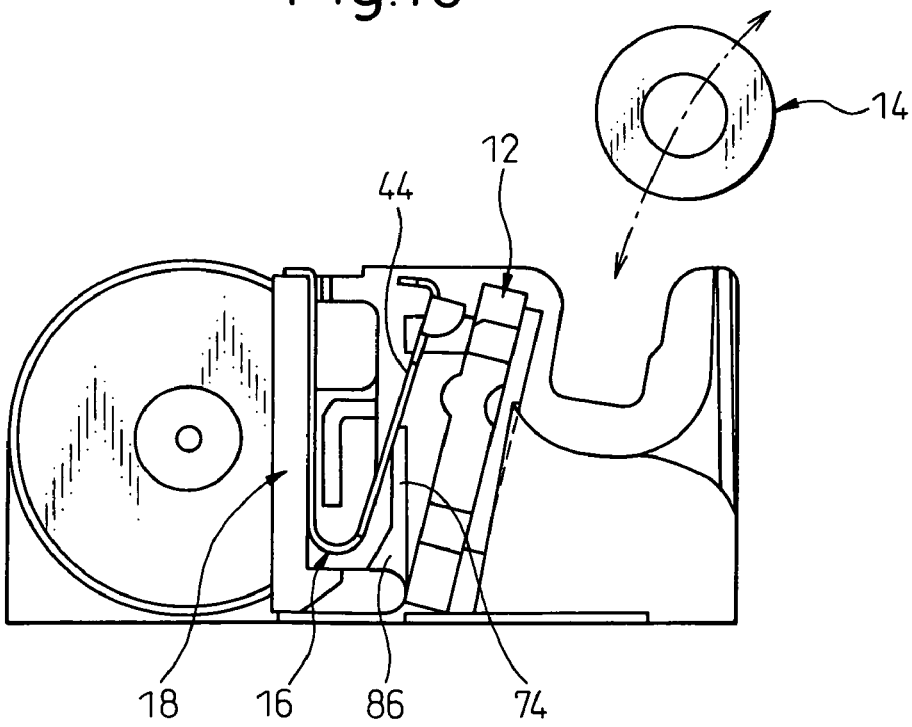
FIG. 10 is a side view corresponding to FIG. 3B and showing a yet further modification of the deflection-defining element.

Further, as shown in FIG. 10, the anchoring elements 74 constituting the deflection-defining elements 72 may be provided in the frame 18. In the illustrated example, a member 86, including an anchoring element 74 formed as a wall or column-like extension, is arranged in the frame 18 at a position enabling the anchoring element 74 to be engaged with the acting portions 44 of the elastic member 16. The anchoring element 74 of the member 86 is engaged with the acting portions 44 of the elastic member 16, so as to anchor the acting portions 44 at the initial deflection position and thus to limit the amount of deflection α (FIG. 5A) of the acting portions 44 within the deflection range R (FIG. 5B), as described above.

Figure 5B:
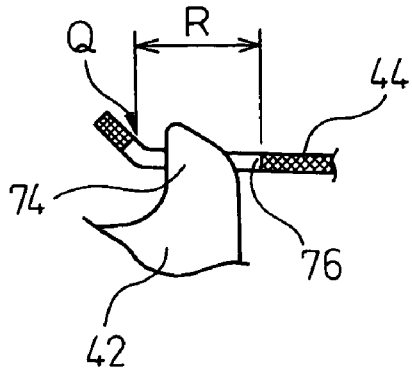
FIG. 5B is an enlarged view showing a deflection-defining element of the biasing-force control mechanism of FIG. 5A.
Figure 5C:
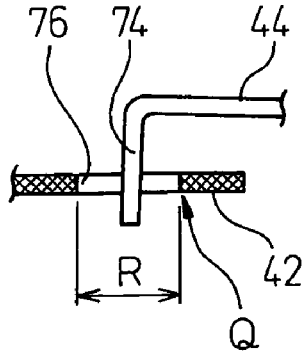
FIG. 5C is an enlarged view showing a modification of a deflection-defining element of the biasing-force control mechanism of FIG. 5A.
Figure 11A:
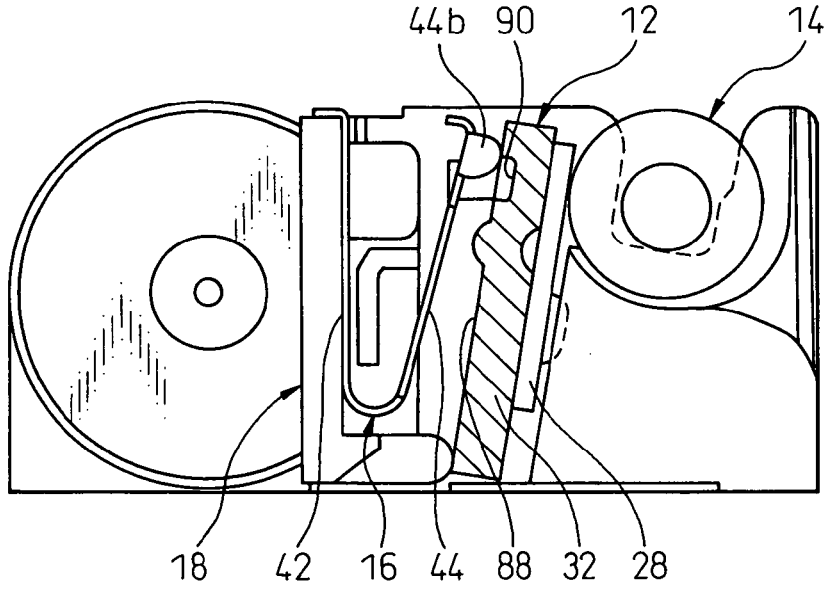
FIGS. 11A and 11B are side views corresponding respectively to FIGS. 3A and 3B and showing a yet further modification of the deflection-defining element.
Figure 11B:
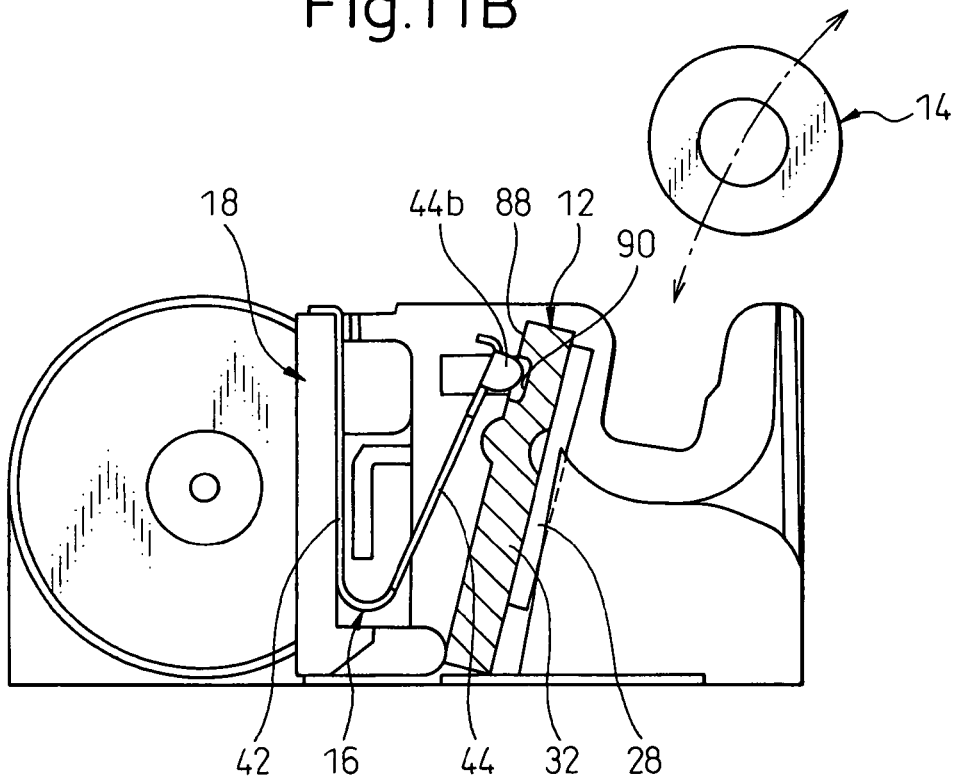

As shown in FIGS. 11A and 11B, the deflection-defining element 72 may include a spring support element 88 provided in the thermal head 12 and adapted to cause a deflection in the elastic member 16 formed as the plate spring within the deflection range R (FIG. 5B). In the illustrated example, the spring support element 88 is constituted as a back surface (i.e., a surface abutting against the acting portions 44 of the elastic member 16) of the carrier plate 32 of the thermal head 12. The spring support element 88 (or the back surface) of the carrier plate 32 is provided at predetermined positions with dents 90 having predetermined dimensions, which are formed to respectively receive the acting ends 44*b* of the acting portions 44 of the elastic member 16. The spring support element 88 is configured so that, during the period when the platen 14 is mounted to the frame 18 (FIG. 11A), the acting ends 44*b* of the acting portions 44 of the elastic member 16 are abutted against the carrier plate 32 outside the dents 90 and, during the period when the platen 14 is removed from the frame 18 (FIG. 11B), the acting ends 44*b* of the acting portions 44 of the elastic member 16 are respectively received in the dents 90. As a result, the amount of deflection α (FIG. 5A) of the elastic member 16 is defined in the predetermined deflection range R (FIG. 5B) such as to generate the contact pressure P due to the biasing force F during the period when the platen 14 is mounted to the frame 18 (FIG. 11A), and as to reduce the biasing force F during the period when the platen 14 is removed from the frame 18 (FIG. 11B).

Figure 12:
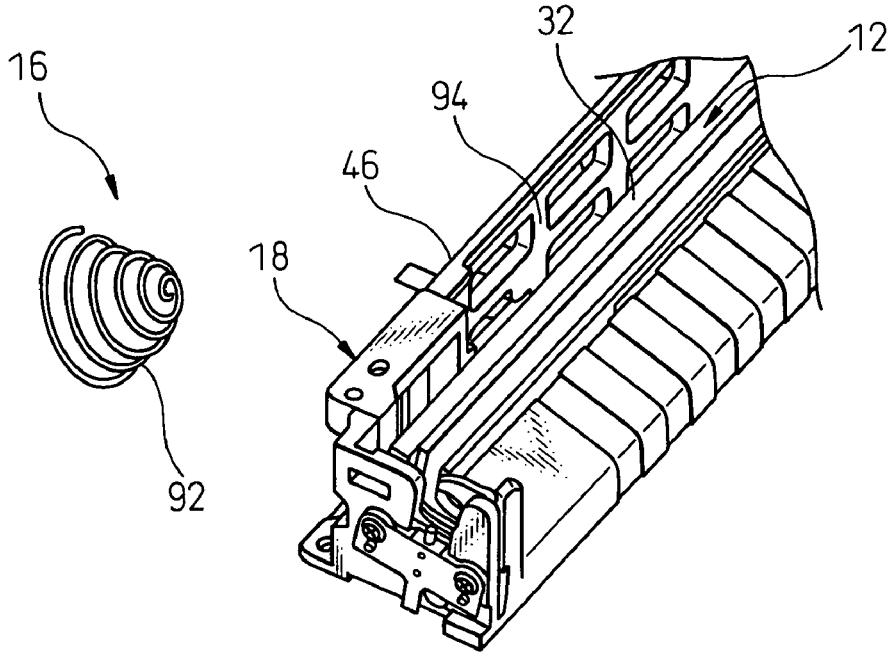
FIG. 12 is an enlarged perspective view showing a yet further modification of the deflection-defining element in a partially exploded manner.

As shown in FIG. 12, in a case where a non-linear spring (a conical coil spring, in the drawing) 92 generating the biasing force assuming non-linear relationship with the amount of deflection is adopted as the elastic member 16, the elastic member 16 can exert, by itself, the biasing-force control function as described above, according to the non-linear characteristics thereof. In this case, the deflection-defining element 72, as one component of the biasing-force control mechanism 70, includes a spring support element 94 provided in the frame 18 and adapted to cause a deflection in the non-linear spring 92 within the deflection range R. In the illustrated example, the front surface (i.e., the surface abutting against the non-linear spring 92) of the main plate member 46 of the frame 18 functions as the spring support element 94.

Figure 13:
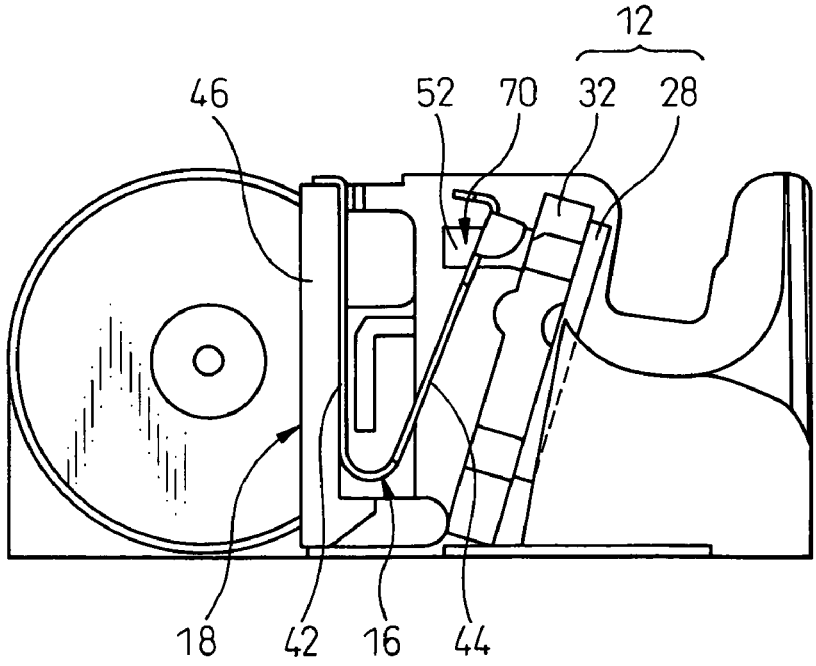
FIG. 13 is a side view illustrating a function of another biasing-force control mechanism in the thermal printer of FIG. 1, with one of side plate members being omitted.

The present invention may also be configured such that the above-described biasing-force control function can be exerted without controlling the deflection of the elastic member 16. For example, as shown in FIG. 13, the above-described various deflection-defining elements 72 for controlling the deflection of the elastic member 16 may be omitted, while the biasing-force control mechanism 70 may be constituted only by the guiding element 52 for guiding the thermal head 12 on the frame 18. More specifically, the guiding element 52 may be configured to guide the thermal head 12 on the frame 18 in a predetermined shifting range such as to generate the contact pressure due to the biasing force of the elastic member 16 during the period when the platen 14 is mounted to the frame 18, and reduce the biasing force to such an extent as to cause no deflection of the thermal head 12 during the period when the platen 14 is removed from the frame 18. In this configuration, the guiding element 52 functions as the biasing-force control mechanism 70 without controlling the deflection of the elastic member 16. In the illustrated example, during a period when the acting portions 44 of the elastic member 16 are located at an unloaded initial position and thus have no deflection, the thermal head 12 is displaced along the guiding element 52 to a position where the carrier plate 32 is spaced from the acting portions 44 of the elastic member 16. According to this configuration, the problem of the deformation of the thermal head 12 can also be solved.

As will be apparent from the above description, according to the present invention, it is possible, for the thermal printer with the detachable platen, to prevent, by a simple structural solution, the thermal head from being deformed due to the biasing force of the elastic member for ensuring the required contact pressure between the thermal head and the platen, and thus to effectively inhibit the deterioration of the printing quality and reduce the burden of maintenance, even under certain structural restrictions in connection with dimensions or assembling workability.

While the invention has been described with reference to predetermined preferred embodiments, it will be understood, by those skilled in the art, that various changes and modifications may be made thereto without departing from the scope of the following claims.

The invention claimed is:

1. A thermal printer comprising:

a thermal head;

a platen cooperating with said thermal head to nip a printing sheet between said platen and said thermal head;

an elastic member applying a biasing force to said thermal head in a direction making contact with said platen;

a frame supporting said thermal head in a shiftable manner and said platen in a detachable manner; and a biasing-force control mechanism controlling said biasing force of said elastic member, said biasing-force control mechanism operating to ensure, when said platen is mounted to said frame, a required contact pressure between said thermal head and said platen under said biasing force and to prevent, when said platen is removed from said frame, said thermal head from being deformed due to said biasing force.

2. A thermal printer as set forth in claim 1, wherein said biasing-force control mechanism comprises a deflection-defining element defining an amount of deflection of said elastic member in a predetermined deflection range such as to generate said contact pressure due to said biasing force when said platen is mounted to said frame and to reduce said biasing force when said platen is removed from said frame.

3. A thermal printer as set forth in claim 2, wherein said elastic member comprises a plate spring; and wherein said deflection-defining element comprises an anchoring element formed in said plate spring and adapted to be engaged with said plate spring itself to limit said amount of deflection within said deflection range.

4. A thermal printer as set forth in claim 3, wherein said anchoring element anchors, when said platen is removed from said frame, said elastic member at an initial deflection position where said contact pressure can be generated by an additional deflection of said elastic member within said deflection range.

5. A thermal printer as set forth in claim 2, wherein said elastic member comprises a plate spring; and wherein said deflection-defining element comprises an anchoring element attached to said plate spring and adapted to be engaged with said plate spring to limit said amount of deflection to within said deflection range.

6. A thermal printer as set forth in claim 5, wherein said anchoring element anchors, when said platen is removed from said frame, said elastic member at an initial deflection position where said contact pressure can be generated by an additional deflection of said elastic member within said deflection range.

7. A thermal printer as set forth in claim 2, wherein said elastic member comprises a plate spring; and wherein said deflection-defining element comprises an anchoring element provided in said frame and adapted to be engaged with said plate spring to limit said amount of deflection to within said deflection range.

8. A thermal printer as set forth in claim 7, wherein said anchoring element anchors, when said platen is removed from said frame, said elastic member at an initial deflection position where said contact pressure can be generated by an additional deflection of said elastic member within said deflection range.

9. A thermal printer as set forth in claim 2, wherein said elastic member comprises a plate spring; and wherein said deflection-defining element comprises a spring support element provided in said thermal head and adapted to cause a deflection in said plate spring within said deflection range.

10. A thermal printer as set forth in claim 2, wherein said elastic member comprises a non-linear spring generating said biasing force assuming non-linear relationship with said amount of deflection; and wherein said deflection-defining element comprises a spring support element provided in said frame and adapted to cause a deflection in said non-linear spring within said deflection range.

11. A thermal printer as set forth in claim 1, wherein said biasing-force control mechanism comprises a guiding element guiding said thermal head on said frame in a predetermined shifting range such as to generate said contact pressure due to said biasing force when said platen is mounted to said frame and to reduce said biasing force when said platen is removed from said frame.

12. A thermal printer as set forth in claim 11, wherein said thermal head comprises a substrate, a heat-generating element disposed on a surface of said substrate, and a carrier plate carrying said substrate with said surface being exposed, said carrier plate being supported on said frame substantially at opposite ends of said carrier plate and guided by said guiding element.

13. A thermal printer as set forth in claim 1, wherein said biasing-force control mechanism operates to arrange said elastic member and said thermal head in a relative positional relationship in which, when said platen is removed from said frame, said biasing force is substantially not applied to said thermal head.

14. A thermal printer as set forth in claim 1, wherein said biasing-force control mechanism operates to arrange said elastic member and said thermal head in a mutual contacting relationship in which, when said platen is removed from said frame, unsteadiness of said thermal head on said frame is prevented.

* * * * *